US012527368B2

(12) United States Patent
Fan et al.

(10) Patent No.: US 12,527,368 B2
(45) Date of Patent: Jan. 20, 2026

(54) PERSONAL COOLING GARMENT AND COOLING DEVICE

(71) Applicant: THE HONG KONG POLYTECHNIC UNIVERSITY, Hong Kong (CN)

(72) Inventors: Jintu Fan, Hong Kong (CN); Lun Lou, Hong Kong (CN); Yiying Zhou, Hong Kong (CN); Yang Hong, Hong Kong (CN)

(73) Assignee: The Hong Kong Polytechnic University, Hong Kong (CN)

( * ) Notice: Subject to any disclaimer, the term of this patent is extended or adjusted under 35 U.S.C. 154(b) by 237 days.

(21) Appl. No.: 18/411,373

(22) Filed: Jan. 12, 2024

(65) Prior Publication Data

US 2025/0228308 A1 Jul. 17, 2025

(51) Int. Cl.

| | |
|---|---|
| ***A41D 13/005*** | (2006.01) |
| ***A41D 27/28*** | (2006.01) |
| *F25D 3/02* | (2006.01) |
| *F25D 3/08* | (2006.01) |

(52) U.S. Cl.

CPC ..... *A41D 13/0053* (2013.01); *A41D 27/28* (2013.01); *A41D 13/0055* (2013.01); *A41D 13/0058* (2013.01); *F25D 3/02* (2013.01); *F25D 3/08* (2013.01); *F25D 2400/26* (2013.01)

(58) Field of Classification Search

CPC ..... A41D 13/0053; A41D 13/0055; A41D 13/0058; A41D 13/0025; A41D 13/005; A41D 13/002; F25D 3/02; F25D 3/08; F25D 3/14; F25D 2400/26; F24F 2221/38; F24F 5/0017

See application file for complete search history.

(56) References Cited

U.S. PATENT DOCUMENTS

| | | | | |
|---|---|---|---|---|
| 3,174,300 | A * | 3/1965 | Webb | B64D 10/00 62/317 |
| 4,649,715 | A * | 3/1987 | Barker | F24F 1/04 2/48 |
| 2005/0034476 | A1* | 2/2005 | Pohr | A41D 13/0055 62/424 |
| 2005/0150251 | A1* | 7/2005 | Navedo | F24F 5/0017 62/530 |
| 2006/0225453 | A1* | 10/2006 | Martello | B60H 1/005 62/425 |
| 2010/0242147 | A1* | 9/2010 | Pohr | A41D 13/0025 2/69 |

* cited by examiner

*Primary Examiner* — Joseph F Trpisovsky
(74) *Attorney, Agent, or Firm* — S&F/WEHRW

(57) ABSTRACT

A personal cooling enclosing material comprises a garment body; an air cooling system provided on an outside surface of the garment body, wherein the air cooling system further comprises a receptacle and a coolant contained in the receptacle; and an air circulation system provided on an inside surface of the garment body for drawing original air from an internal space inside the garment body for cooling. The air circulation system is separated from the air cooling system to avoid direct contact of the original air with the coolant of the air cooling system. The air cooling system is in thermal communication with the air circulation system.

22 Claims, 12 Drawing Sheets

PERSONAL COOLING GARMENT AND COOLING DEVICE

TECHNICAL FIELD

The present disclosure generally relates to a personal cooling garment and a cooling device. In particular, the present disclosure relates to a personal cooling garment for lowering the body temperature of a wearer and reducing the risk of heat stroke during outdoor activities, while overcoming the discomfort associated with the sensation of wetness.

BACKGROUND

Occupational workers who engage in intense physical activities are exposed to heat stress, particularly in hot ambient environments. The direct exposure to the sun during outdoor activities in summer is very detrimental to outdoor workers. Heat will accumulate when the body's heat dissipation ability cannot balance the heat generated during work, which increases the occurrence of heat exhaustion. Heat dissipation can be enhanced through evaporation, conduction, convection, and radiation.

Various cooling strategies have been introduced to alleviate heat stress and ensure optimal work performance, including pre-cooling (cooling prior to activity), cooling during activity, and post-cooling (cooling after activity). Industrial fans, powered by heavy motors, have been used as cooling measures to ventilate air around the body for promoting convective and evaporative heat transfer. Nonetheless, limited working spaces and lack of electricity may render such cooling measures inaccessible. Cold water immersion with temperature of 10 to 20° C. has been verified by researchers to reduce core temperature. However, the delivery and storage of cold water may not be feasible. Several studies have utilized cold water drinks (14 to 16° C.), but the effectiveness in alleviating heat strain has been limited.

A personal cooling garment (PCG) has been proven to be effective in reducing the risk of heat-related illnesses and injuries. Various studies have been conducted for different PCGs, such as air cooling garment, phase change cooling garment, liquid cooling garment, and evaporative cooling garment. It has been proposed that PCGs as portable devices can provide better cooling than industry fans and cold water. Conventional air cooling garments, which blow ambient air into the clothing microclimate, fail to provide effective cooling as cooling is restricted by the air temperature. Evaporative cooling garments, phase change cooling garments, and liquid cooling garments have been suggested as effective ways to provide cooling, but they are all heavy and cause discomfort due to the sensation of wetness on the skin. Hybrid cooling systems, such as combination of air cooling and phase change cooling, or combination of liquid cooling and phase change cooling, have been proposed to improve cooling performance, but they still have some limitations in terms of weight and the sensation of wetness on the skin.

Previous surveys have indicated that commercial cooling vests used by outdoor workers were not well-adopted by them due to insufficient cooling power, short cooling duration, and poor ergonomic design.

There is a need in the art for a personal cooling system for outdoor workers which can overcome the discomfort associated with the sensation of wetness, enhance the cooling performance, and improve overall comfort for outdoor workers. Furthermore, other desirable features and characteristics will become apparent from the subsequent detailed description and the appended claims, taken in conjunction with the accompanying drawings and this background of the disclosure.

SUMMARY OF THE INVENTION

Provided herein is a personal cooling garment, comprising: a garment body; an air cooling system provided on an outside surface of the garment body, wherein the air cooling system further comprises a receptacle and a coolant contained in the receptacle; and an air circulation system provided on an inside surface of the garment body for drawing original air from an internal space inside the garment body for cooling. The air circulation system is separated from the air cooling system to avoid direct contact of the original air with the coolant of the air cooling system. The air cooling system is in thermal communication with the air circulation system.

Also provided is a cooling device for an internal space enclosed by a housing, comprising: an air cooling system provided on an outside surface of the housing, wherein the air cooling system further comprises a receptacle and a coolant contained in the receptacle; and an air circulation system provided on an inside surface of the housing for drawing original air from the internal space for cooling. The air circulation system is separated from the air cooling system to avoid direct contact of the original air with the coolant of the air cooling system. The air cooling system is in thermal communication with the air circulation system.

BRIEF DESCRIPTION OF THE DRAWINGS

The appended drawings contain figures to further illustrate and clarify the above and other aspects, advantages, and features of the present disclosure. It will be appreciated that these drawings depict only certain embodiments of the present disclosure and are not intended to limit its scope. It will also be appreciated that these drawings are illustrated for simplicity and clarity and have not necessarily been depicted to scale. The present disclosure will now be described and explained with additional specificity and detail through the use of the accompanying drawings.

DETAILED DESCRIPTION

The disclosure will be more fully described below with reference to the accompanying drawings. However, the present disclosure may be embodied in a number of different forms and should not be construed as being limited to the embodiments described herein.

The benefits, advantages, solutions to problems and any element(s) that may cause any benefit, advantage, or solution to occur or become more pronounced are not to be construed as critical, required, or essential features or elements of any or all of the claims. The invention is defined solely by the appended claims including any amendments made during the pendency of this application and all equivalents of those claims as issued.

In the claims which follow and in the preceding description of the invention, except where the context requires otherwise due to express language or necessary implication, the word "comprise" or variations such as "comprises" or "comprising" is used in an inclusive sense, i.e., to specify the presence of the stated features but not to preclude the presence or addition of further features in various embodiments of the invention.

The values recited herein are exemplary, and are not intended to limit the present invention to a particular configuration or set of values, but only indicate one possible set of values, unless otherwise indicated herein.

Figure 1A:
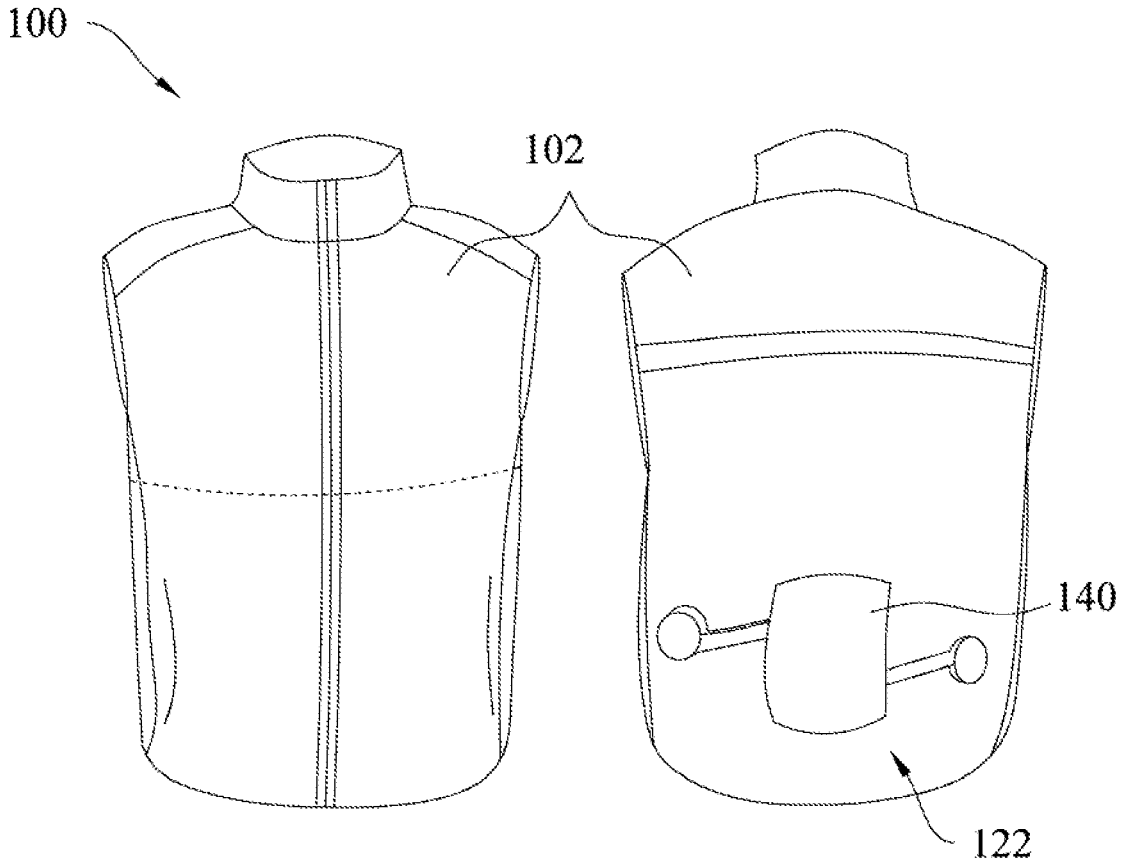
FIG. 1A and FIG. 1B show personal cooling garments according to certain embodiments of the present disclosure.

FIG. 1A shows a personal cooling garment 100 according to certain embodiments of the present disclosure. The personal cooling garment 100 comprises a garment body 102, an air cooling system 140 (shown in FIG. 3A and FIG. 3B), and an air circulation system 160 (shown in FIG. 5). The air cooling system 140 is provided on an outside surface of the garment body 102. The air circulation system 160 is provided on an inside surface of the garment body 102 for drawing original air from an internal space inside the garment body 102 for cooling. The personal cooling garment 100 is configured to lower the body temperature of a wearer and reduce the risk of heat stroke during outdoor activities, while overcoming the discomfort associated with the sensation of wetness.

In certain embodiments, the present disclosure may also be implemented as a cooling device for an internal space enclosed by a housing, a film, or other barrier materials. The cooling device comprises an air cooling system 140, and an air circulation system 160. The air cooling system 140 is provided on an outside surface of the housing. The air circulation system 160 is provided on an inside surface of the housing for drawing original air from the internal space for cooling.

Figure 1B:
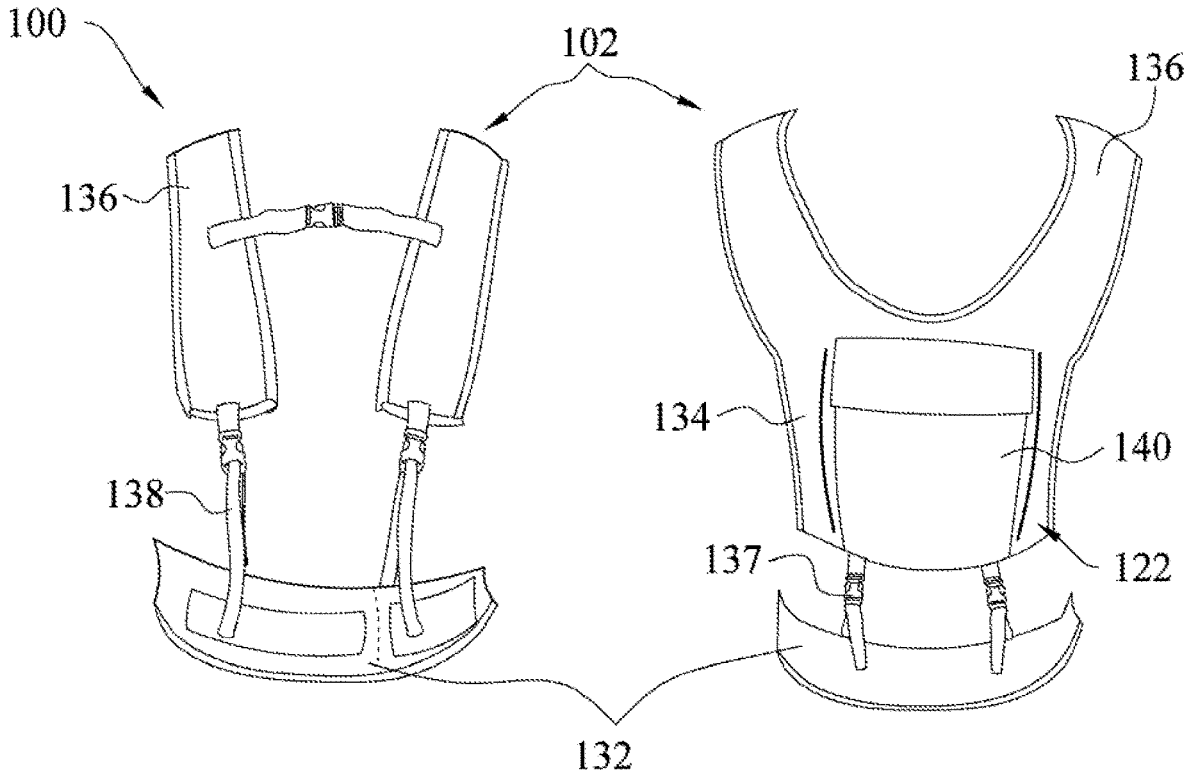

The garment body 102 can be any type of clothing made of any materials suitable to be worn by the wearer, particularly for outdoor activities. FIG. 1A illustrates the garment body 102 as a vest with a front zipper. It is apparent that the garment body 102 may also be other clothing without departing from the scope and spirit of the present disclosure, for example, vests, jackets, coats, tops, construction uniforms, fireman uniforms, work clothes, pants, trousers, shorts, and the like. FIG. 1B shows a personal cooling garment 100 with another type of garment body 102 according to certain embodiments of the present disclosure. As shown in FIG. 1B, the garment body 102 comprises a waist strap 132, a back pad 134, and two shoulder straps 136 connected to the back pad 134. The waist strap 132 is to be worn around the waist of the user, and the back pad 134 is to be worn at the back of the user. When in use, the back pad 134 is connected to the waist strap 132 via one or more strap buckles 137, and the two shoulder straps 136 cross over the shoulders of the user and are connected to the waist strap 132 via one or more strap buckles 138.

While the garment body 102 can be made of any material, it is desirable to minimize the escape of air from the inside to the outside of the garment body 102. Therefore, a fabric with low air permeability, yet still breathable, is preferred. Also, considering the outdoor environmental conditions, it is important to protect the skin from excessive ultraviolet (UV) light exposure. Nylon, which effectively absorbs UV radiation in the wavelength range of 280-400 nm, can be chosen as the outer shell material of the garment body 102.

In certain embodiments, the garment body 102 is provided with a container 122 for holding the air cooling system 140 and the air circulation system 160. In the illustrated embodiment shown in FIG. 1A and FIG. 1B, the container 122 is located at the lower back of the garment body 102. It is apparent to one skilled in the art that the container 122 may be located at other suitable positions of the garment body 102, such as the upper front (chest), lower front (abdomen), or lower side (waist), without departing from the scope and spirit of the present disclosure.

Figure 2A:
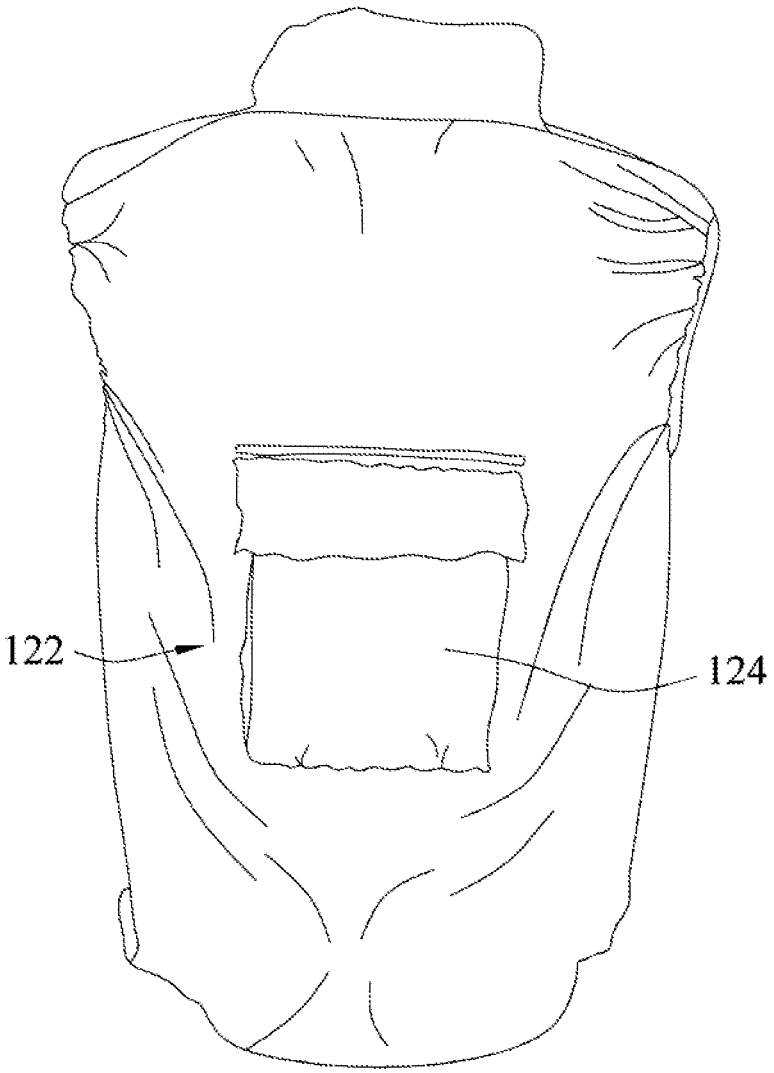
FIG. 2A and FIG. 2B shows the structure of a container according to certain embodiments of the present disclosure.
Figure 2B:
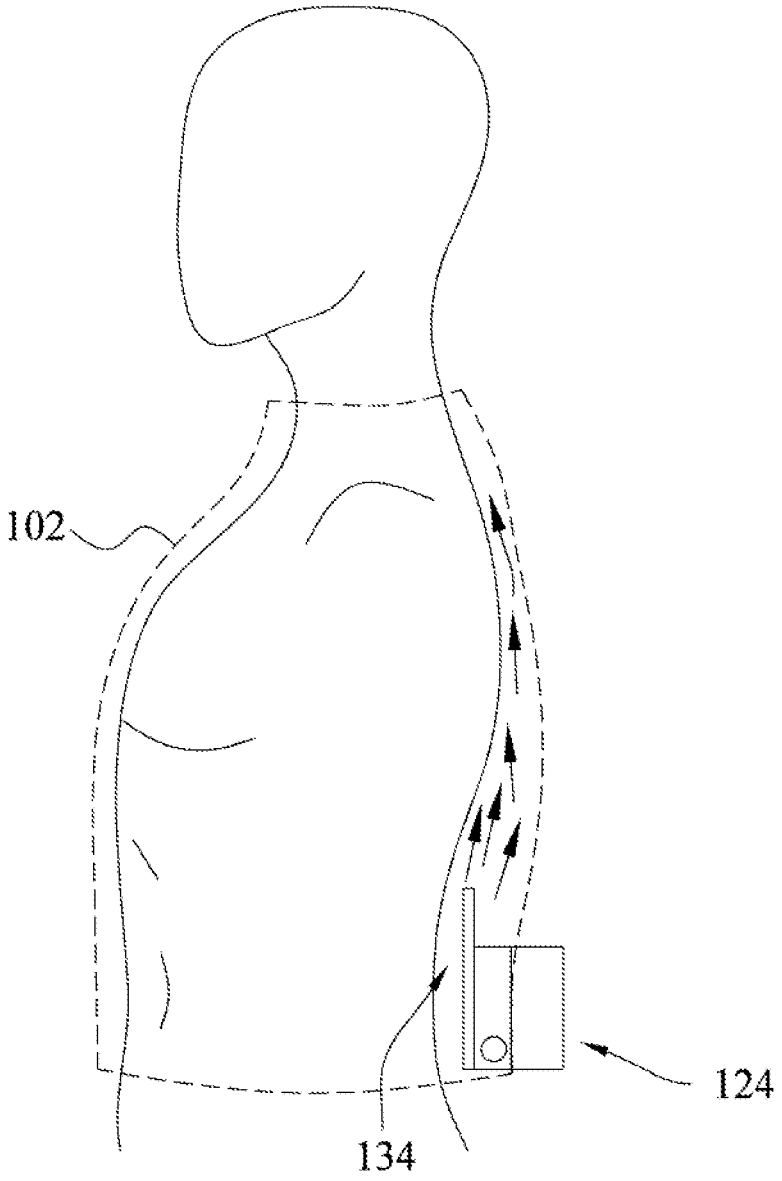

FIG. 2A and FIG. 2B shows the structure of the container 122 according to certain embodiments of the present disclosure. The container 122 comprises an external compartment 124 and an internal compartment 134, whose positions are indicated in FIG. 2B. The external compartment 124 is a compartment attached to the garment body 102 and accessible from outside. Preferably, the external compartment 124 is provided at the lower back of the garment body 102. The internal compartment 134 is a separated compartment placed within the garment body 102 facing the wearer and is not accessible from outside.

Figure 3A:
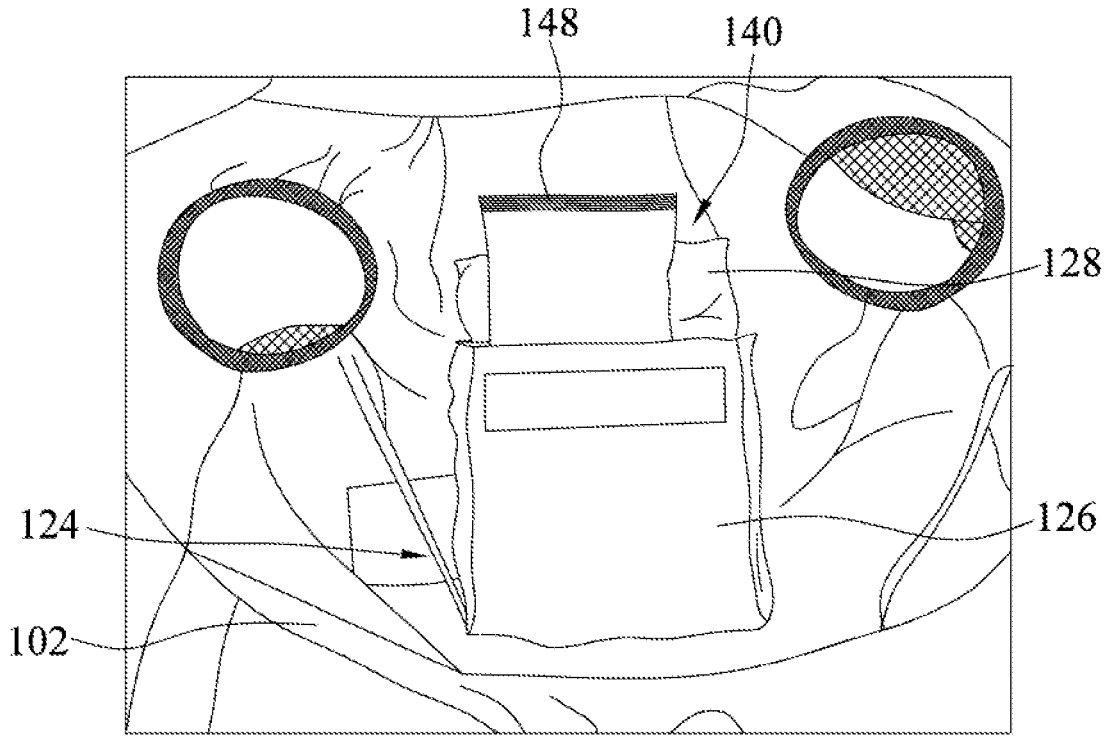
FIG. 3A and FIG. 3B show the external compartment of the container, containing the air cooling system, according to certain embodiments of the present disclosure.
Figure 3B:
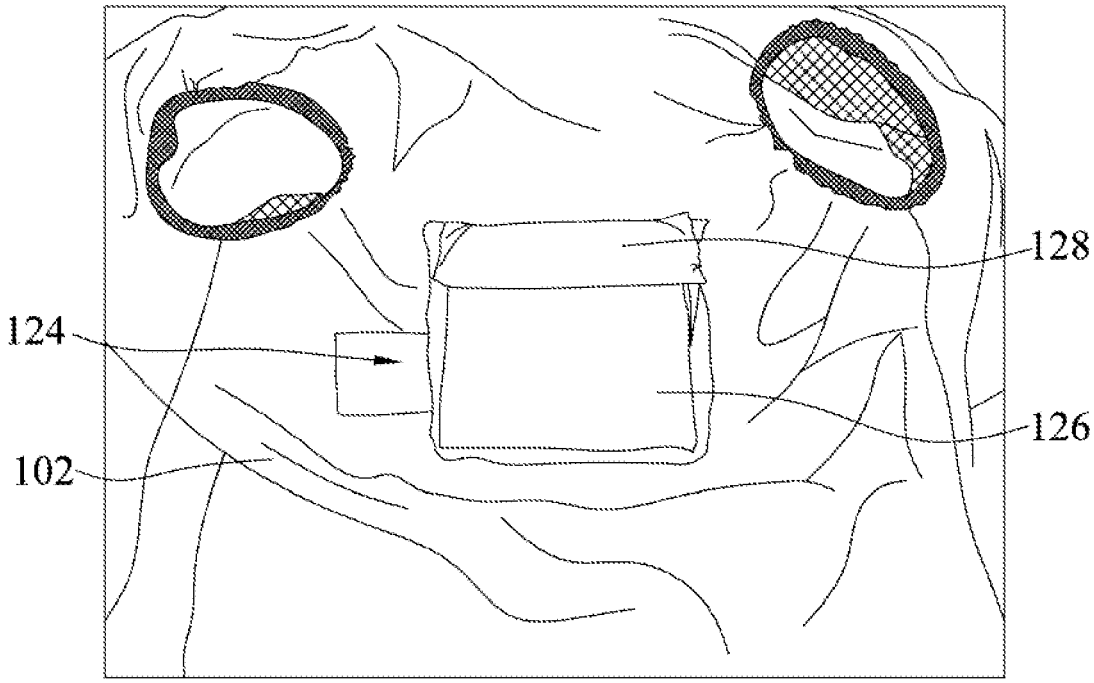

FIG. 3A and FIG. 3B show the external compartment 124 of the container 122 for accommodating the air cooling system 140, according to certain embodiments of the present disclosure. The external compartment 124 can have a pocket design, comprising a pocket 126 attached to the garment body 102 from the outside, and preferably a cover 128 for closing the pocket 126. The cover 128 and the pocket 126 can be sewn to the garment body 102 or otherwise attached or affixed to the garment body 102 in any other suitable means, such as by adhesion or Velcro tapes, or integrated into the garment body 102. As shown in FIG. 3A, the cover 128 is attachable to the pocket 126 by a Velcro tape or other hook-and-loop interface, wherein the Velcro tape comprises a loop surface and a hook surface respectively provided on the upper part of the pocket 126 or the underside of the cover 128. The Velcro tape is used to affix the cover 128 to the pocket 126 for closing the pocket 126, as shown in FIG. 3B. The external compartment 124 is used to accommodate the air cooling system 140.

Moreover, a thermal insulation layer (not shown) can be provided outside the external compartment 124 to reduce the heat loss to the environment. In certain embodiments, the thermal insulation layer is formed on or attached to the pocket 126, comprising a material having a low thermal conductivity value.

Figure 4A:
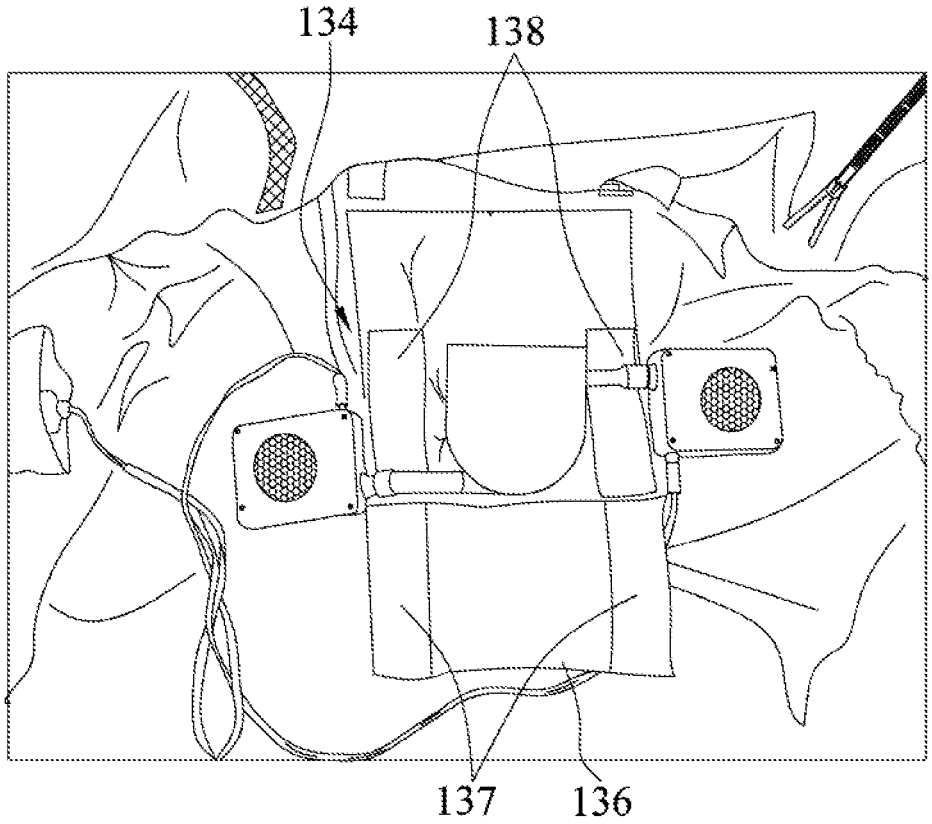
FIG. 4A and FIG. 4B show the internal compartment of the container according to certain embodiments of the present disclosure.
Figure 4B:
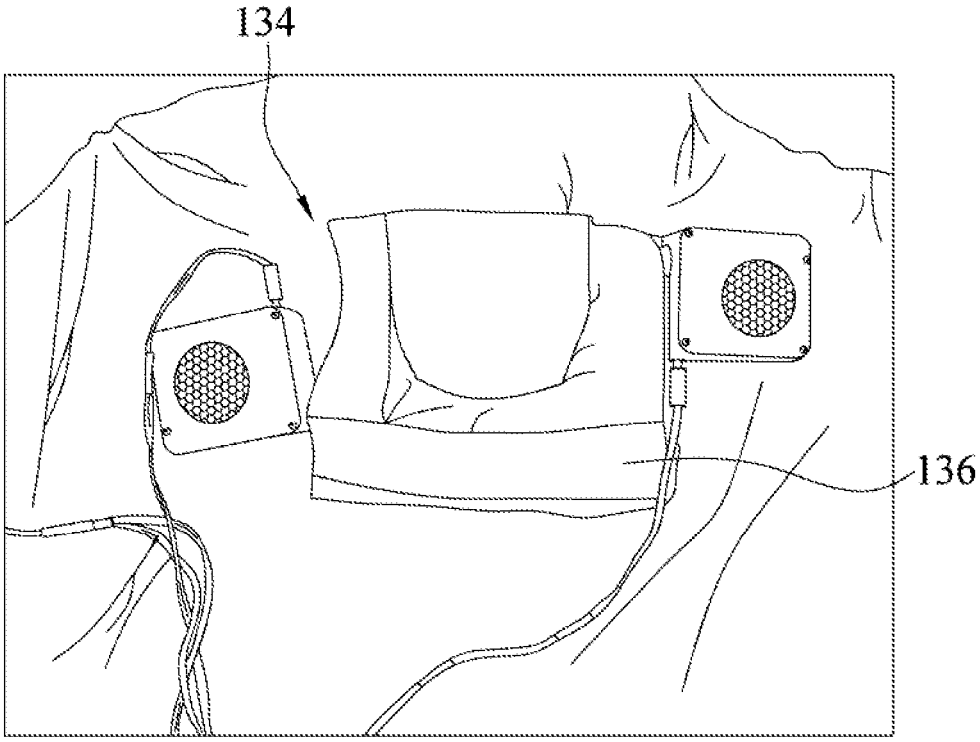

FIG. 4A and FIG. 4B show the internal compartment 134 of the container 122 according to certain embodiments of the present disclosure. As shown in the figures, the internal compartment 134 comprises Velcro tapes and a cover piece 136. The cover piece 136 has a rectangular shape with two short edges and two long edges, wherein one of the long edges attached or affixed to the inside surface of the garment body 102. The Velcro tapes include two base pieces 138 on the garment body 102 and two hook-and-loop interfaces 137 provided on the two short edges of the cover piece 136. In particular, the based pieces 138 are attached to the inside surface of the garment body 102 and are provided with hook/loop surfaces so that the two hook-and-loop interfaces 137 of the cover piece 136 can mate with the hook/loop surfaces of the base pieces 138 to form an internal pocket for at least partially holding the air circulation system 160.

It is apparent that the internal compartment 134 can also be provided as a pocket attached on the inside surface of the garment body 102 according to certain embodiments similar to the pocket 126 shown in FIG. 3A and FIG. 3B. Similarly, the external compartment 124 can also be made of Velcro tapes.

As shown in FIG. 3A, the air cooling system 140 is provided on an outside surface of garment body 102, in particular, the external compartment 124 of the container 122. The air cooling system 140 is used for cooling the air taken from the inside of the garment body 102. In certain embodiments, the air cooling system 140 comprises a receptacle 148 and a coolant contained in the receptacle 148. The coolant may be ice, cold water, or any other suitable coolant (such as dry ice). The receptacle 148 can be any container, such as a plastic bag, a tin foil bag, or the like. The coolant can be added into the receptacle 148, sealed and embedded in the pocket 126 of the external compartment 124.

Figure 5:
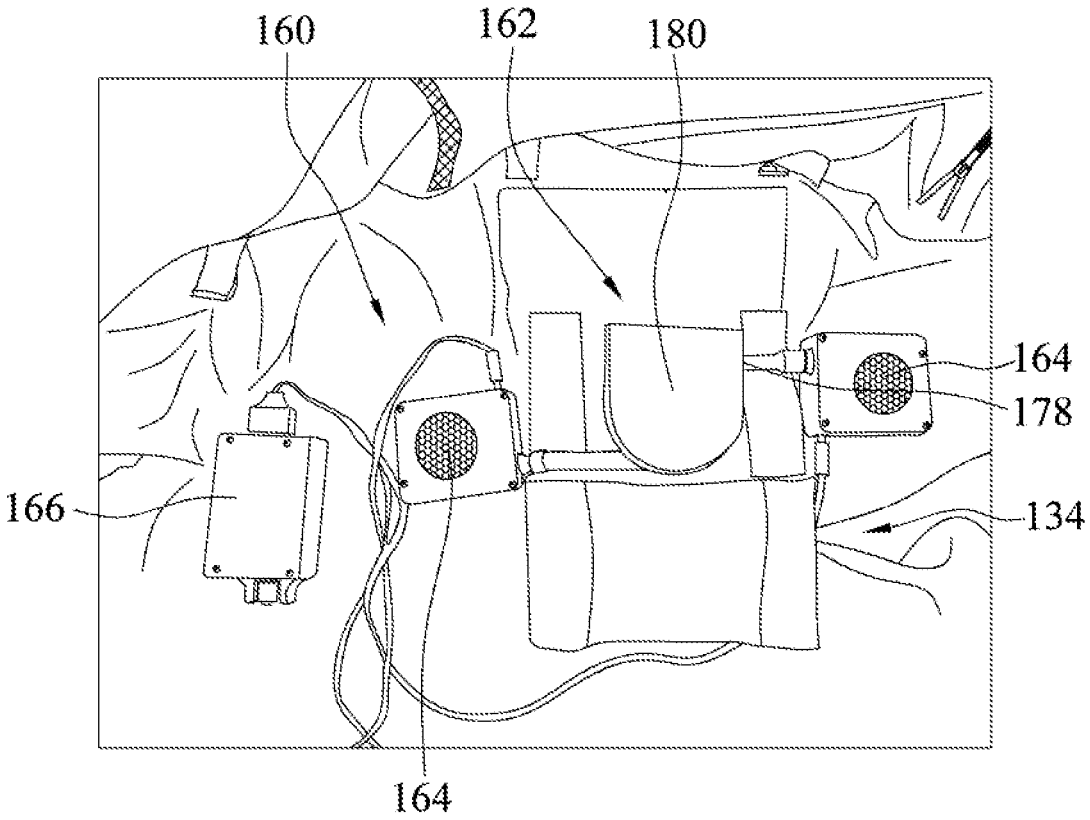
FIG. 5 shows an air circulation system according to certain embodiments of the present disclosure.

FIG. 5 shows an air circulation system 160 according to certain embodiments of the present disclosure. The air circulation system 160 is provided on an inside surface of the garment body 102, in particular, the air circulation system 160 is positioned in the internal compartment 134 of the container 122. The air drawn from the internal space into the air circulation system is considered as original air. The air circulation system 160 comprises an air chamber 162 that opens to the internal space inside the garment body 102, one or more blowers 164, and a battery pack 166. The one or more blowers 164 are in fluid communication with the air chamber 162 for facilitating an intake of the original air from an internal space inside the garment body 102 and delivering the original air to the air chamber 162 for cooling. The battery pack 166 may comprises one or more battery cells and is electrically connected to the one or more blowers 164 for powering them. The one or more battery cells may be rechargeable cells, such as lithium-ion battery, lithium polymer battery, nickel metal hydride battery, or the like. The battery pack 166 may be placed in the front pockets or any other positions.

Advantageously, the air circulation system 160 is separated from the air cooling system 140 to avoid direct contact of the original air with the coolant of the air cooling system 140. Therefore, the original air would not be delivered to the air cooling system to contact the coolant in the air cooling system, so as to avoid adding moisture, which may cause discomfort associated with the sensation of wetness. The air cooling system 140 is in thermal communication with the air circulation system 160 for heat exchange.

Figure 6A:
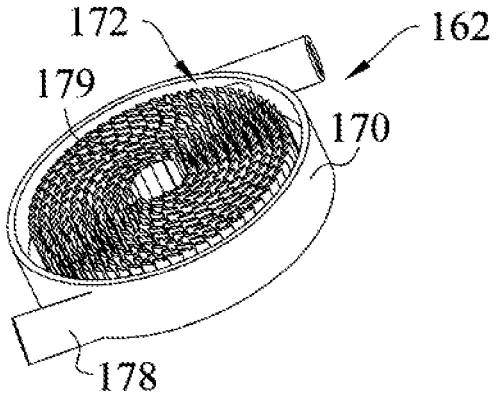
FIG. 6A and FIG. 6B show an air chamber of the air circulation system according to certain embodiments of the present disclosure.
Figure 6B:
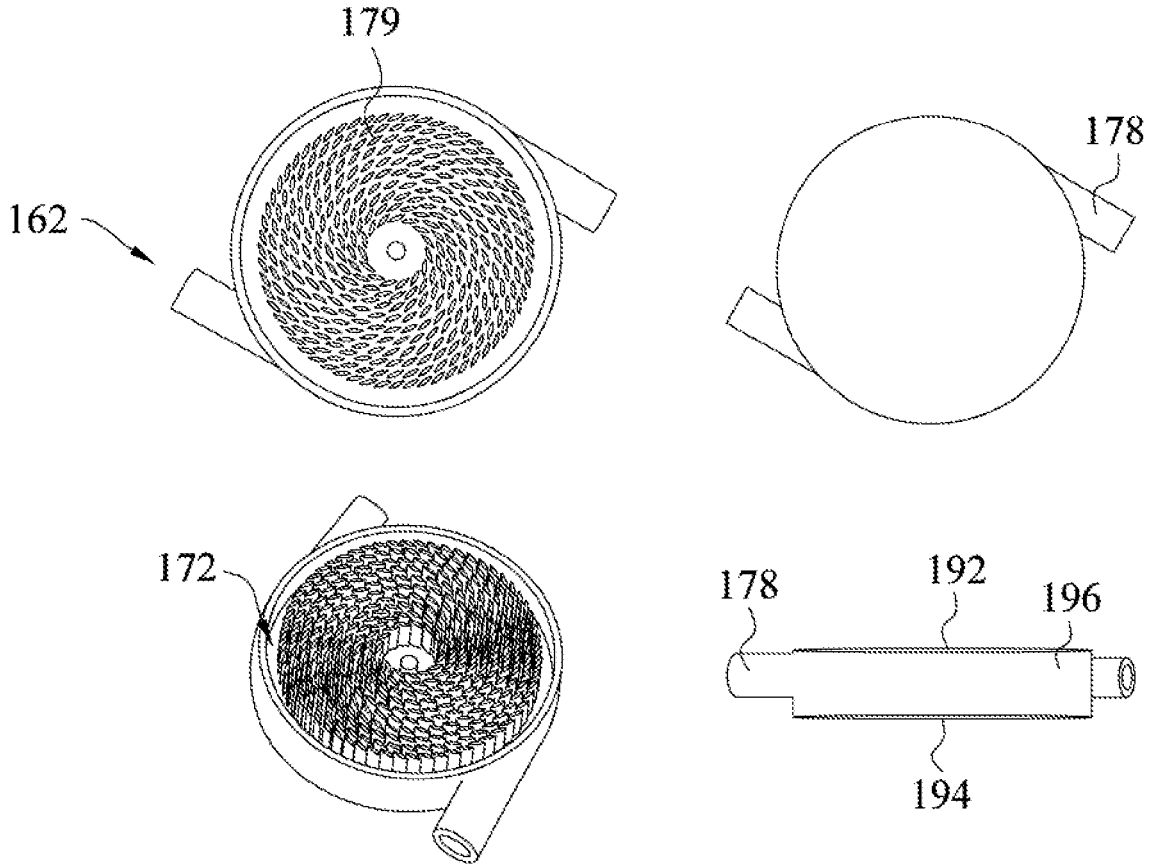

FIG. 6A and FIG. 6B show an air chamber 162 according to certain embodiments of the present disclosure. The air chamber 162 comprises a chamber body 170 with an opening 172 and one or more air inlets 178. As shown in FIG. 5, the one or more air inlets 178 are tubes respectively connected to the outlets of the one or more blowers 164.

The chamber body 170 can be a hollow box having a lower base surface 194 and a lateral surface 196 protruding from and substantially perpendicular to lower base surfaces 192. The lower base surface 194 and the lateral surface 196 can be made separately and fixed or assembled together. They can also be formed integrally.

In certain embodiments, the chamber body 170 can optionally have an upper base surface 192. In certain embodiments, the upper base surface 192 and the lower base surface 194 are identical and arranged in parallel. Preferably, the upper base surface 192 is provided with the opening 172, and the lateral surface 196 is provided with the one or more air inlets 178. In certain embodiments, the one or more air inlets 178 are tubes tangentially aligned with the peripheral of the chamber body 170 along the lateral surface 196. The upper and the lower base surfaces can have a shape of a circle (as shown in FIG. 6A and FIG. 6B), a square, or any other suitable shapes.

As shown in FIG. 6A and FIG. 6B, the chamber body 170 may further comprise plural fins 179 arranged in a pattern to guide the circulation of the original air in the air chamber 162 and to improve heat exchange between the original air and the coolant in the air cooling system 140. In certain embodiments, the plural fins 179 are arranged in a space within the chamber body 170. Each of the plural fins 179 is protruded from the lower base surfaces of the chamber body 170. Preferably, the plural fins 179 are uniformly arranged in rows and columns, or in concentric circles. When in use, the air chamber 162 is placed in a way that the lower base surface 194 of the chamber body 170 faces the garment body 102 and the upper base surface 179 faces the body of the wearer.

Figure 8A:
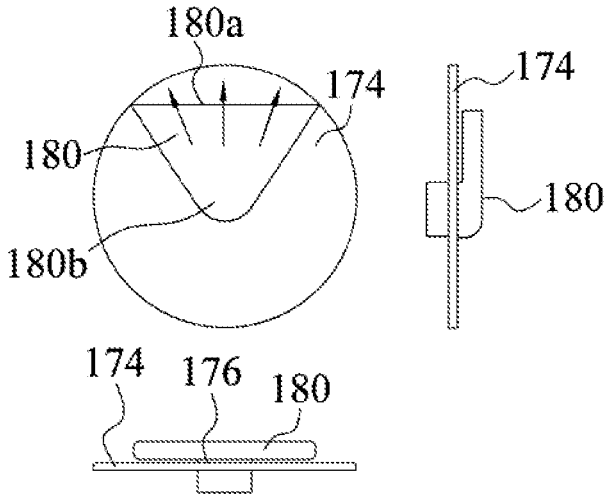
FIG. 8A, FIG. 8B and FIG. 8C show a lid of the air chamber and an air distribution system according to certain embodiments of the present disclosure.
Figure 8B:
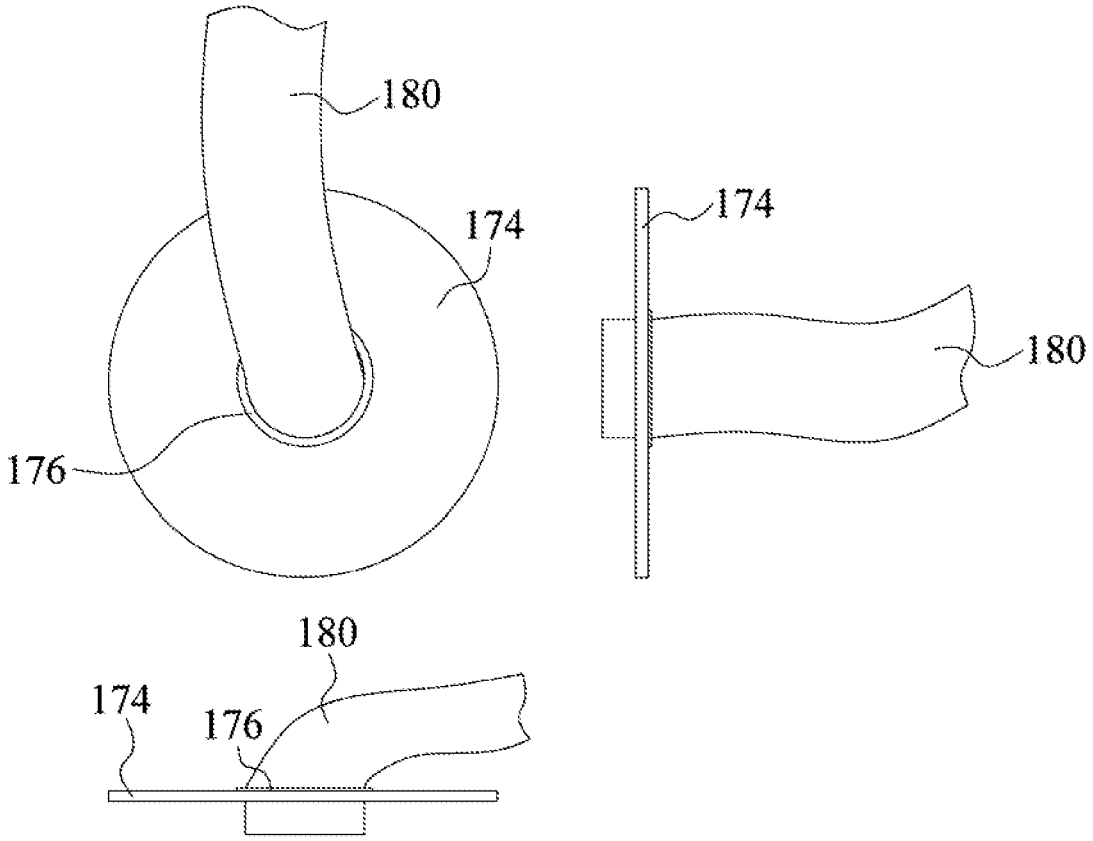
Figure 8C:
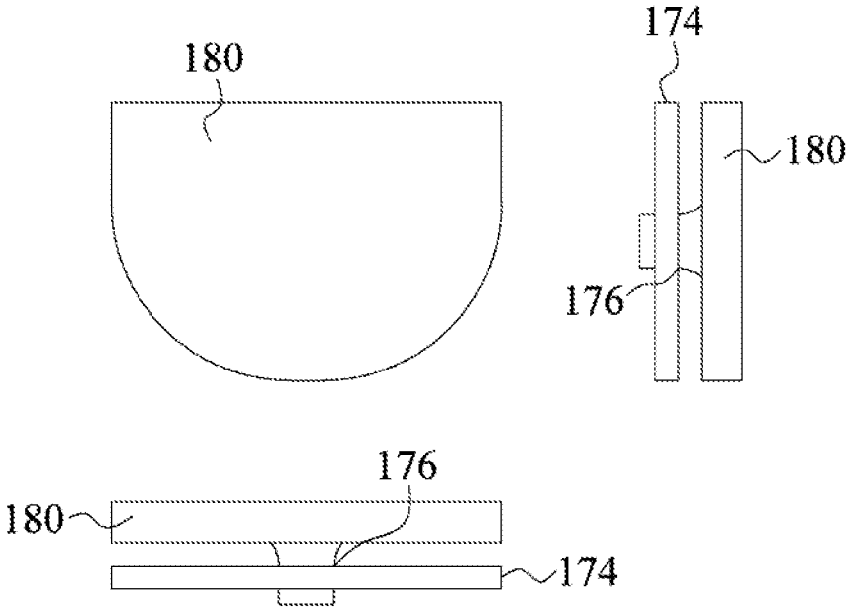

In certain embodiments, the air chamber 162 can optionally have a lid 174. Certain embodiments of the lid 174 are shown in FIG. 8A, FIG. 8B and FIG. 8C, which also show an air distribution system to be described later. The lid 174 can be made of plastic with an outlet 176. Preferably, the outlet 176 is positioned substantially at the center of the lid 174. The chamber body 170 can be made of aluminum alloy, which can be fabricated by selective laser melting (SLM) 3D printing or any appropriate metal work technologies, followed with a 300° C. heat treatment to improve the corrosion resistance. The lid 174 can be fabricated through stereolithography (SLA) 3D printing with ultra tough resin (UTR), such as UTR 9000E. The one or more blowers 164 can any commercially available blowers with suitable weight, air flow rate, size, and cooling effect. (i.e. how well it matched the garment body 102).

The outlets of the one or more blowers 164 are connected to the air inlets 178 of chamber body 170 of the air chamber 162 so that the original air can be circulated from the one or more blowers 164 into the chamber body 170.

The one or more blowers 164 are used to facilitate an intake of the original air from an internal space inside the garment body 102 and deliver the original air to the air chamber 162 for cooling. As the air cooling system 140 is in thermal communication with the air circulation system 160, the original air is circulated in the air chamber 162 and undergoes heat exchange with the coolant in the air cooling system 140. The chilled air is then vented back to the internal space inside the garment body 102 for lowering the body temperature of the wearer. In one embodiment, the chilled air is vented through the opening 172 of the chamber body 170. In an alternative embodiment, the chilled air is vented back to the internal space inside the garment body 102 through the outlet 176 of the lid 174.

The air circulation system 160 can be activated by a manual knob (not shown) located in, e.g., the battery pack 166.

The personal cooling garment 100 may further comprise an adjusting knob or dial (not shown), which is provided in the air chamber 162 to control and adjust the temperature of the chilled air.

Figure 7:
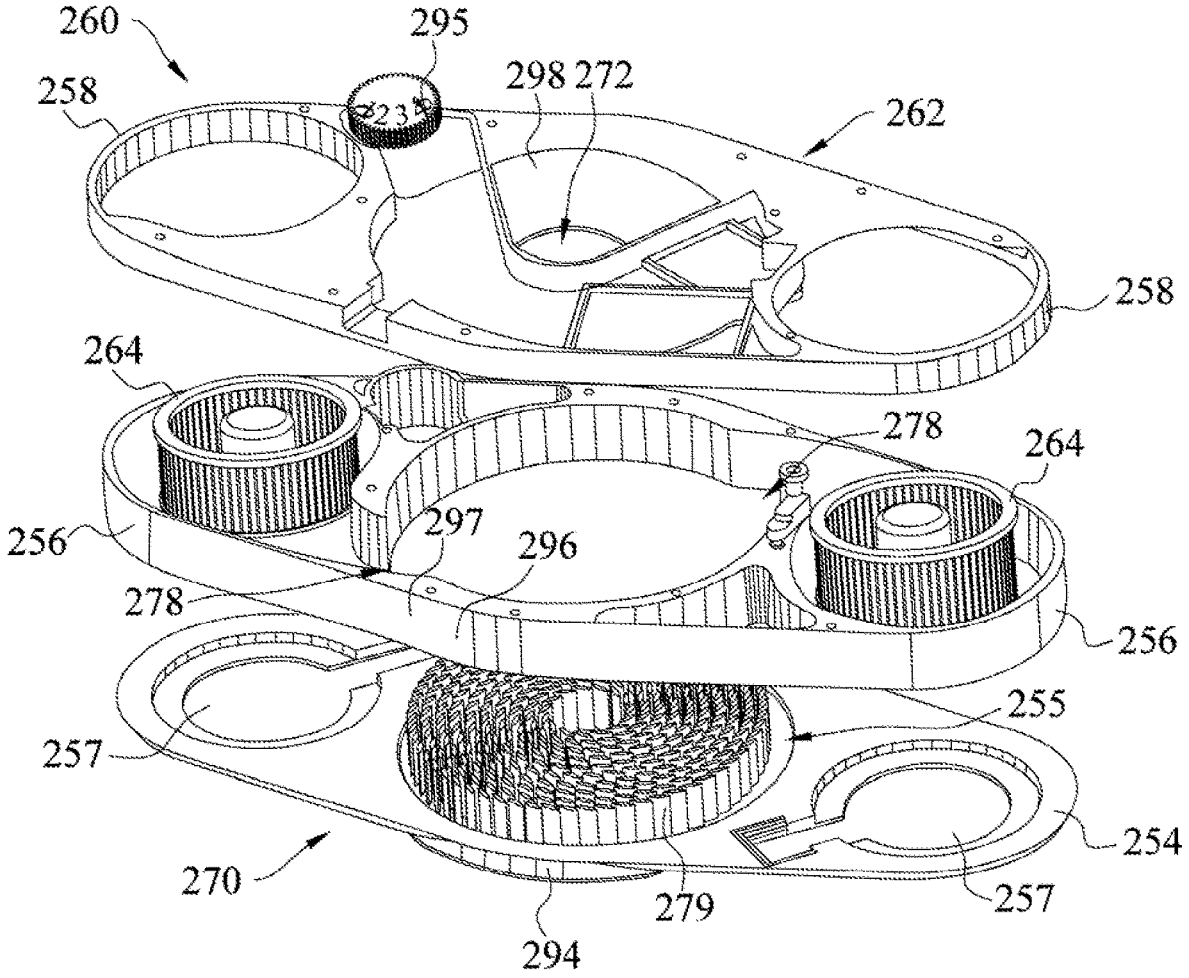
FIG. 7 shows an air circulation system according to certain embodiments of the present disclosure.

FIG. 7 shows an air circulation system 260 according to certain embodiments of the present disclosure. The air circulation system 260 as shown in FIG. 7 is similar to the air circulation system 160 as shown in FIG. 5, FIG. 6A and FIG. 6B, except that the chamber body and the one or more blowers are integrated together.

As shown in FIG. 7, the air circulation system 260 comprises an air chamber 262 that opens to the internal space inside the garment body 102, one or more blowers 264, and a battery pack (not shown). The air chamber 262 comprises a chamber body 270 and one or more air inlets 278. The chamber body 270 has a lower base surface 294, a lateral surface 296, and optionally an upper base surface 298 with an opening 272. The lower base surface 294, the lateral surface 296, and the upper base surface 298 are made separately and fixed or assembled together to form the chamber body 270. Plural fins 279 protrude from the lower base surface 294.

As shown in FIG. 7, the lateral surface 296 of the chamber body 270 has an external surface 297 and an internal surface 299. One or more hollow cylinders 256 are provided on the external surface 297 of the lateral surface 296, so as to respectively accommodate the one or more blowers 264. The one or more air inlets 278 are respectively disposed between the one or more hollow cylinders 256 and the lateral surface 296 to fluidly connect the one or more blowers 264 accommodated in the one or more hollow cylinders 256 and chamber body 270 respectively. Optionally, a lower rack 254 can be provided to hold the one or more blowers 264 respectively accommodated in the one or more hollow cylinders 256. As shown in FIG. 7, the lower rack 254 can be a plate whose shape conforms to the section of the one or more hollow cylinders 256 and the chamber body 270. The plate has an opening 255 at the center, which accommodates the lower base surface 294 of the chamber body 270, and one or more recesses 257 to hold the one or more blowers 264. Optionally, the upper base surface 298 can also be provided one or more hollow cylinders 258 to respectively accommodate the one or more blowers 264. The one or more blowers 264 can be fixed to the one or more hollow cylinders 256 or be held in position by the one or more recesses 257 of the lower rack 254. Optionally, an adjusting dial 295 can be provided on the upper base surface 298 for controlling and adjusting the one or more blowers 264.

Further, the personal cooling garment 100 can further comprise an air distribution system to distribute chilled air from the air circulation system 160, 260. As shown in FIG. 8A, FIG. 8B and FIG. 8C, an air distribution system 180 can be provided to distribute the chilled air from the opening 172 of the chamber body 170 of the air chamber 162. In certain embodiments as shown in FIG. 8A, the air distribution system 180 comprises a flat triangular prism fluidly connected to the air chamber 162 and with one side surface 180*a* open. In FIG. 8A, the flat triangular prism is fluidly connected to the air chamber 162 by connecting the angle 180*b* opposite the open side surface 180*a* to the air outlet 176 of the lid 174 via a tube. It is apparent that flat triangular prism can be fluidly connected to the air chamber 162 through any other appropriate ways. In certain embodiments, the flat triangular prism can be expanded into a flat box with the cross-section being a combination of a semicircle and a rectangle, which covers the whole lid 174 so that the air chamber 162 and its lid 174 are invisible from above, as shown in FIG. 5 and FIG. 8C. In certain embodiments as shown in FIG. 8B, the air distribution system 180 comprises one or more flexible pipes for distributing the chilled air to different positions of the internal space inside the garment body 102. Preferably, the one or more flexible pipes are arranged to directly connect to the opening 172 or to the air outlet 176 of the lid 174, and redirect the chilled air to different positions of the internal space inside the garment body 102. Therefore, the chilled air can be distributed evenly for lowering the body temperature of the wearer. In FIG. 8B, the one or more flexible pipes are illustrated as one flexible pipe connected to the air outlet 176 of the lid 174. It is apparent that they can be two or more flexible pipe directly connected to the opening 172 or to the air outlet 176 of the lid 174. The above embodiments refer to the air circulation system 160 to illustrate the air distribution system 180, it is apparent to one skilled in the art that the above air distribution system 180 can be also applied to the air circulation system 260 shown in FIG. 7 or any other embodiments of the air circulation system.

Figure 9:
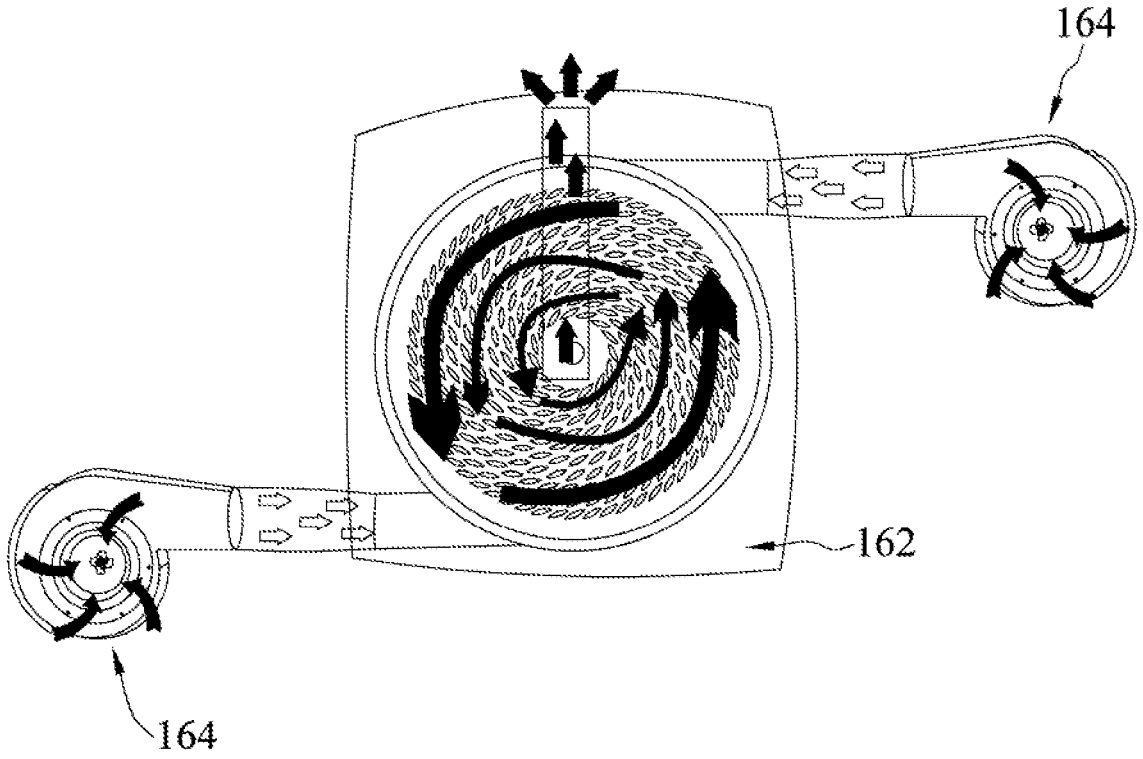
FIG. 9 shows the air flow path within a personal cooling garment according to certain embodiments of the present disclosure.

As stated above, the air taken from the internal space inside the garment body 102 is considered as original air. FIG. 9 shows the air flow path within a personal cooling garment according to certain embodiments of the present disclosure. As illustrated in FIG. 9, with the personal cooling garment 100, the original air from an internal space inside the garment body 102 is taken by the blowers 164 into the air chamber 162 and passes through the plural fins 179 in the air chamber 162, where the original air exchanges heat with the coolant in the air cooling system 140 (not shown in FIG. 9) and thus is chilled. The chilled air is then vented back to the internal space inside the garment body 102 for lowering the body temperature of the wearer.

In one embodiment, the chilled air is vented through the opening 172 of the chamber body 170 of the air chamber 162. In an alternative embodiment, the chilled air is vented through the outlet 176 of the lid 174. If there is an air distribution system 180, the chilled air is vented into the air distribution system 180 for distributing evenly to different positions of the internal space inside the garment body 102. The coolant in the air cooling system 140 is in thermal communication with the air entering the air chamber 162 and passing through the plural fins 179 to continuously exchange heat with the original air, which can take away the excess heat on the body surface.

As can be seen from the above, the original air, taken by the blowers 164 into the air chamber 162 and passing through the plural fins 179 in the air chamber 162, exchanges heat with the coolant contained in the receptacle 148 of the air cooling system 140 outside the garment body 102. Thus, the air chamber 162 avoids direct contact of the original air with the coolant of the air cooling system 140. The cool and dry original air (or referred to as "chilled air") is used to cool the human body of the wearer. As a result, this process can separate the coolant from the original air, which can effectively cool the original air and avoid adding moisture to the original air. The cooling efficiency can also be enhanced.

Figure 10:
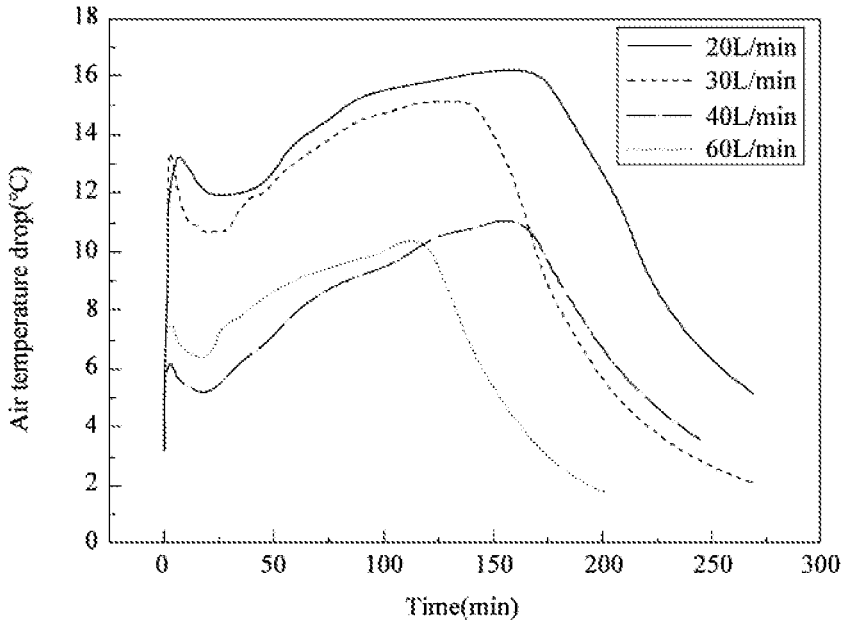
FIG. 10 shows the air temperature drop of outlet for different air flow rate under the environmental condition of 30° C., 40% relative humidity (RH).

FIG. 10 shows the air temperature drop of outlet for different air flow rate under the environmental condition of 30° C., 40% RH. As shown in FIG. 10, the cooling efficiency of the newly designed personal cooling garment was investigated with a thermal manikin (constant mean skin temperature: 35° C.) under the environmental condition of 30° C., 40% RH. When the cooling function of the cooling system was turned on (the adjusting knob turned on and coolant filled), the air temperature was measured at the outlet, which can be regarded as the microclimate temperature inside the cooling garment. When it started to cool, the total power input was 5 W and we tested the air temperature drop at the outlet with different flow rate of blowers (20, 30, 40 and 60 L/min). The experimental results showed that the cooling power increased when the ice started to melt, and the cooling power gradually decreased after all ice melted. The optimum cooling effect could provide about 16° C. temperature drop in clothing microclimate when the flow rate is 20 L/min. The ice inserted in pocket was about 0.3 kg, it could last for more than 200 minutes under different air flow rates.

This illustrates a cooling device and the personal cooling garment in accordance with the present disclosure. It will be apparent that variants of the above-disclosed and other features and functions, or alternatives thereof, may be integrated into other apparatus. The present embodiment is, therefore, to be considered in all respects as illustrative and not restrictive. The scope of the disclosure is indicated by the appended claims rather than by the preceding description, and all changes that come within the meaning and range of equivalency of the claims are therefore intended to be embraced therein.

What is claimed is:

1. A personal cooling garment comprising:

a garment body;

an air cooling system provided on an outside surface of the garment body, wherein the air cooling system further comprises a receptacle and a coolant contained in the receptacle; and an air circulation system provided on an inside surface of the garment body for drawing original air from an internal space inside the garment body for cooling, wherein:

the air circulation system is separated from the air cooling system to avoid direct contact of the original air with the coolant of the air cooling system; and the air cooling system is in thermal communication with the air circulation system.

2. The personal cooling garment according to claim 1, wherein the air circulation system further comprises:

an air chamber that opens to the internal space inside the garment body;

one or more blowers in fluid communication with the air chamber for facilitating an intake of the original air from the internal space inside the garment body and delivering the original air to the air chamber; and a battery pack electrically connected to the one or more blowers for powering the one or more blowers.

3. The personal cooling garment according to claim 2, wherein the air chamber comprises a chamber body with an opening and one or more air inlets; and wherein the one or more air inlets are respectively connected to the one or more blowers.

4. The personal cooling garment according to claim 3, wherein the chamber body is a hollow box having a lower base surface and a lateral surface protruding from and substantially perpendicular to the lower base surfaces, and wherein the lateral surface is provided with the one or more air inlets.

5. The personal cooling garment according to claim 4, wherein the chamber body further comprises an upper base surface provided with the opening.

6. The personal cooling garment according to claim 4, wherein the chamber body and the one or more blowers are integrated together, one or more hollow cylinders are provided on the external surface of the lateral surface of the chamber body so as to respectively accommodate the one or more blowers, with the air inlets respectively disposed between the one or more hollow cylinders and the lateral surface.

7. The personal cooling garment according to claim 4, wherein the one or more air inlets are tubes tangentially aligned with the peripheral of the chamber body along the lateral surface.

8. The personal cooling garment according to claim 4, wherein the chamber body further comprises plural fins arranged in a space within the chamber body.

9. The personal cooling garment according to claim 8, wherein each of the plural fins is protruded from the lower base surface of the chamber body, and wherein the plural fins are uniformly arranged in rows and columns, or in concentric circles.

10. The personal cooling garment according to claim 2, wherein the air chamber further comprises a lid having an outlet, and wherein the original air is cooled in the air chamber and vented back to the internal space inside the garment body through the outlet of the lid.

11. The personal cooling garment according to claim 2 further comprising an air distribution system for distributing chilled air from the air chamber to different positions of the internal space inside the garment body, wherein the air distribution system comprises a flat triangular prism fluidly connected to the air chamber and with one side surface open, or the air distribution system comprises one or more flexible pipes fluidly connected to the air chamber, or the air distribution system comprises a flat box fluidly connected to the air chamber and having a cross-section being a combination a semicircle and a rectangle.

12. The personal cooling garment according to claim 1, wherein the garment body comprises a container, wherein the container comprises an external compartment for accommodating the air cooling system and an internal compartment for accommodating the air circulation system.

13. The personal cooling garment according to claim 12, wherein the internal compartment is placed within the garment body and comprises Velcro tapes and a cover piece, or a pocket attached to the inside surface of the garment body.

14. The personal cooling garment according to claim 12, wherein the external compartment comprises a pocket attached to the garment body, and a cover for closing the pocket.

15. The personal cooling garment according to claim 14, wherein a thermal insulation layer is provided outside the external compartment to reduce heat loss; and wherein the thermal insulation layer comprises a material having a low thermal conductivity value.

16. The personal cooling garment according to claim 1, wherein the coolant comprises ice, cold water, or dry ice.

17. A cooling device for an internal space enclosed by a housing, the cooling device comprising:

an air cooling system provided on an outside surface of the housing, wherein the air cooling system further comprises a receptacle and a coolant contained in the receptacle; and an air circulation system provided on an inside surface of the housing for drawing original air from the internal space for cooling, wherein:

the air circulation system is separated from the air cooling system to avoid direct contact of the original air with the coolant of the air cooling system; and the air cooling system is in thermal communication with the air circulation system.

18. The cooling device according to claim 17, wherein the air circulation system further comprises:

an air chamber that opens to the internal space inside the housing;

one or more blowers in fluid communication with the air chamber for facilitating an intake of the original air from the internal space inside the housing and delivering the original air to the air chamber; and a battery pack electrically connected to the one or more blowers for powering the one or more blowers.

19. The cooling device according to claim 18, wherein the air chamber comprises a chamber body with an opening and one or more air inlets, and wherein the one or more air inlets are respectively connected to the outlets of the one or more blowers.

20. The cooling device according to claim 19, wherein the chamber body is a hollow box having a lower base surface, and a lateral surface protruding from and substantially perpendicular to the lower base surfaces, and wherein the lateral surface is provided with the one or more air inlets.

21. The cooling device according to claim 20, wherein the chamber body further comprises plural fins arranged in a space within the chamber body; wherein each of the plural fins is protruded from the lower base surface of the chamber body; and wherein the plural fins are uniformly arranged in rows and columns, or in concentric circles.

22. The cooling device according to claim 17, wherein the coolant comprises ice, cold water, or dry ice.

* * * * *